US005105064A

United States Patent [19]

Kresock

[11] Patent Number: 5,105,064

[45] Date of Patent: Apr. 14, 1992

[54] APPARATUS AND METHOD FOR FUSING AN IMAGE ONTO A RECEIVER ELEMENT

[75] Inventor: John M. Kresock, Elba, N.Y.

[73] Assignee: Eastman Kodak Company, Rochester, N.Y.

[21] Appl. No.: 722,788

[22] Filed: Jun. 28, 1991

[51] Int. Cl.[5] ..... G03G 15/20

[52] U.S. Cl. ..... 219/216; 219/388

[58] Field of Search ..... 219/216, 388, 469, 470, 219/471, 411, 405; 355/286

[56] References Cited

U.S. PATENT DOCUMENTS

| | | | |
|---|---|---|---|
| 3,187,162 | 6/1965 | Hojo | 219/388 |
| 3,731,612 | 5/1973 | Schmidt | 219/216 |
| 3,833,794 | 9/1974 | Moriyama | 219/502 |
| 3,961,236 | 6/1976 | Rodek et al. | 323/18 |
| 4,001,541 | 1/1977 | Hatch et al. | 219/216 |
| 4,140,894 | 2/1979 | Katakura et al. | 219/358 |
| 4,354,095 | 10/1982 | deVries | 219/388 |
| 4,435,637 | 3/1984 | deVries | 219/358 |
| 4,551,007 | 11/1985 | Elter | 355/286 |
| 4,649,261 | 3/1987 | Sheets | 219/411 |
| 4,680,447 | 7/1987 | Mahawili | 219/405 |
| 4,859,832 | 8/1989 | Uehara | 219/411 |

*Primary Examiner*—Teresa J. Walberg

[57] ABSTRACT

An efficient, precisely controlled apparatus for and method of heat fusing an image onto a receiver element, such as a slide transparency. The apparatus includes a light chamber which integrates and directs to an open end of the chamber light from an area light source which emits black body radiation at a given color temperature. A receiver element with an image to be fused is positioned adjacent to the open end of the chamber and the light source is turned and off by an electric timing and control circuit. The electric circuit precisely controls the color temperature of the light source. The circuit also electronically measures the temperature rise during fusing of the image to the receiver element then immediately turns off the light the instant complete fusing is accomplished. The method includes the steps of controlling the color temperature of the light source in accordance with optimum energy absorption by the image and by the surface of the receiver element, applying the light energy with a controlled intensity pattern to obtain highly uniform temperature rise over the area of the image including its edges, and measuring the rise in temperature produced by the light and turning the light source off as soon as a desired image fusing temperature at the surface of the receiver element is reached such that uniform fusing of the image without distortion of the receiver element is obtained.

13 Claims, 3 Drawing Sheets

TRIAC POWER SUPPLY
120V 60Hz AC
AC $V_{OUT}$
(ADJ. V. REF.)
TIMER
PULSE GENERATOR
START
(+ INPUT SIGNAL)
AMP
TEMP SET
+V

APPARATUS AND METHOD FOR FUSING AN IMAGE ONTO A RECEIVER ELEMENT

FIELD OF THE INVENTION

This invention relates to an apparatus for and a method of heat fusing quickly, uniformly and permanently an image printed on a receiver element such as a slide transparency.

BACKGROUND OF THE INVENTION

In a thermal printer, such as is described in U.S. patent application Ser. No. 457,593 (filed Dec. 27, 1990, in the names of S. Sarraf, et al.), entitled "Thermal Printer", and assigned to the same assignee as the present patent application, a dye-donor element is placed in contact with a dye-receiving element onto which an image is to be printed. Then the donor element is irradiated by ultra-fine, focused spots of light from a laser. This operation applies heat to the donor element in the immediate vicinity of a light spot which heats the dye in the donor element to its vaporization temperature and transfers a small "dot" of dye to the surface of the receiver element. The laser light beam and its focused spot is scanned sequentially across the donor and receiver elements at high speed and with great accuracy and precision. While being scanned the laser light is modulated by electronic signals, which are representative of the shape, color, and detail of an image to be printed onto the receiver element. Successive dye-donor elements of different colors (e.g., cyan, magenta, and yellow) may be used to print full-color images on the receiver element. After the desired image has been transferred dot-by-dot from the donor element or elements onto the receiver element, it is necessary for the image to be permanently bonded or fused to the receiver element.

The image containing receiver element can be a slide transparency which is projected with enlargement (e.g., at 100 power magnification) onto a large screen. Seemingly minor distortions, or physical unevenness in the receiver element itself, or inaccuracy or non-uniform reproduction of an image, particularly a fine detail full-color image, are thus greatly magnified and can be visually objectionable. Thus there is a need for an extremely high degree of fidelity in the printed receiver image. This imposes stringent performance requirements on the mechanical, thermal and optical qualities of the receiver element itself, on the fidelity of the image printed on the receiver, and on the manufacturing process by which the receiver and image are bonded together.

It has been found to be advantageous, from the standpoint of high quality of the final product and for ease of operation in a thermal printer such as described above, to use individual molded plastic members as the dye-receiving elements when making slide transparencies. These plastic members can be produced as blanks in the exact shape and size of a standard transparency. They can then, without special handling or care in storage, be loaded into a magazine in the printer and used for printing one by one as required. Using the electronically controlled thermal printing process just described, a printer can, in a very short time and using an entirely "dry" process, print onto one of these plastic members a full-color, highly faithful reproduction of an image suitable for projection.

After an image, in the form of these small dots of dye (pixels) has been deposited by a thermal printer on the surface of a plastic receiver element, it is further necessary to bond or fuse the dots of dye to this surface so that they can not be rubbed off. The use of solvents or chemicals to bond the pixels of dye is undesirable because of fumes and for other considerations. On the other hand, thermal fusing or melt bonding the pixels of dye to the surface of the receiver element has proven difficult in the past because of many conflicting factors Using poorly controlled heat sources, such as a hot air blower or a coiled nichrome "toaster" wire, the results were not fully satisfactory because of resulting physical distortions caused by uneven heating of the receiver element. Uncontrolled heating also results in uneven or inadequate fusing of the dye pixels.

It is desirable to provide a fast, efficient apparatus for and method of heat fusing a dye-transfer image onto a plastic receiver element The end result is a low cost, rugged element (e.g., slide transparency) which has an image of high definition permanently fused to it without visual distortion or unevenness.

SUMMARY OF THE INVENTION

In accordance with one aspect of the present invention there is provided a precisely controlled highly efficient apparatus for heat fusing a printed image onto a receiver element quickly, with visually perfect uniformity, and with exact repeatability. This apparatus includes a hollow, light-integrating chamber one end of which has an opening in which a receiver element with image to be fused can be held. The opposite end of the light-integrating chamber holds a distributed light source of radiant heat energy. Light from this source is reflected and integrated by the inner walls of the chamber which are highly reflecting. The integrated light in the chamber is directed onto the receiver element to give a desired distribution of heat energy over the center and along the corners and edges of the image on the element. In this way the image over its entire area fuses uniformly into the surface of the receiver element in spite of variation in density of the image or of non-uniform thermal mass in different areas of the receiver element. The thermal mass of the receiver element itself may be greater in some regions of its structure (e.g , along its thicker supporting edges) than in other regions. The power level and color temperature of the light source are exactly controlled to predetermined values by an electric timing and control circuit. This circuit by controlling the color temperature of the light to an optimum value insures that the dye pixels of an image are uniformly fused into the surface of the receiver element in spite of wide variation in the density of pixels from a minimum to a maximum value. And even though the surface of the receiver element is momentarily raised to its melting point, this is done so evenly, to such a minute depth, and so quickly that the receiver, especially in the area of the image, is not differentially stressed during fusing and hence not left permanently distorted afterward. The timing and control circuit includes temperature measuring means located not in contact with the receiver element itself but at a place where the instantaneous temperature on the surface of the receiver element corresponds accurately with the temperature measured by the temperature measuring means. As soon as the temperature on the receiver surface becomes hot enough for the dye image to have fused completely into this surface, the electric circuit turns off the light source. Thus over-heating of the receiver element (and consequent physical distortion) is avoided even though its surface to a minute depth is momentarily brought to melting point. Since this surface temperature is so accurately and instantaneously controlled, and (by virtue of the integrating chamber) so even throughout the area of the receiver image, it is doubly advantageous to use a powerful light source. Thus the cycle time from when the light source is turned on until fusing of an image is completed and the light is turned off is only about 60 seconds. The highly repeatable performance of the timing and control circuit insures uniform results during normal operation whether one receiver element or many are being fused. This circuit and its related apparatus are highly efficient in application of power and they contain fail-safe means so that overheating or faulty operation are prevented.

In accordance with another aspect of the invention a receiver element having a surface of a thermoplastic material of desired optical, thermal and mechanical properties has a dye-transfer image quickly and uniformly fused to its surface by the method comprising the steps of directing a large amount of radiant light energy toward the receiver element from a light source which emits black body radiation and which has a color temperature; controlling the color temperature of the light energy in accordance with optimum absorption of the energy by the dye image and by the thermoplastic surface of the receiver element; applying the energy of radiation of the light to the thermoplastic surface of the receiver element with a controlled intensity pattern to obtain highly uniform temperature rise over the image area including its edges; and measuring the rise in temperature produced by the radiation and turning off the light energy as soon as a desired image fusing temperature at the surface of the receiver is reached, so that uniform fusing of the image without distortion of the receiver is obtained.

The receiver element with its fused image produced by this method is low in cost, high in quality and very durable.

A better understanding of the invention, together with its important advantages will best be gained from a study of the following description given in conjunction with the accompanying drawings.

DETAILED DESCRIPTION

Figure 1:
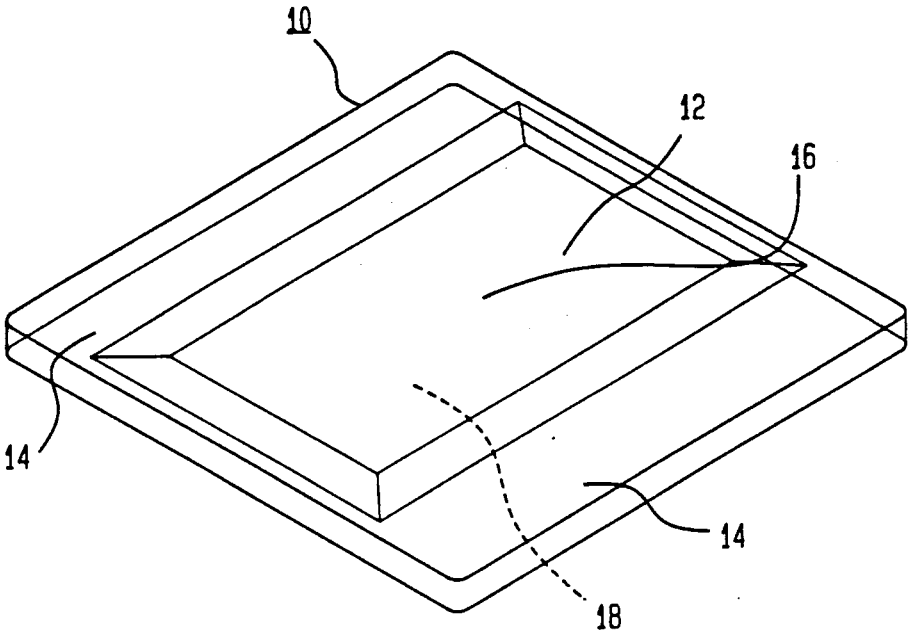
FIG. 1 is a perspective view of a print receiving element, shown here as a blank for a slide transparency, having a surface on which an image can be thermally printed and heat fused.

Referring now to FIG. 1, there is shown a receiver element 10, having a thin rectangular center section 12 surrounded by somewhat thicker edge portions 14. The center section 12 has a smooth flat top surface 16 and a parallel smooth flat bottom surface 18. The rectangular area of top surface 16 is adapted to have printed thereon a high definition color image such as produced by a thermal printer described above and disclosed in U.S. patent application Ser. No. 457,593. Receiver element 10 is useful as a blank for a slide transparency. It is advantageously molded of a thermoplastic material having suitable optical, thermal and mechanical properties. One such material which is particularly suitable for this application is clear polycarbonate having a melting point of about 150° C. A receiver element 10 molded of such a material has a highly uniform transparent center section 12, which can be made thin yet thick enough to resist physical deformation. The edge portions 14 are integral with center section 12 and are enough thicker to resist bending or twisting of the receiver element 10. These edge portions 14 may also be color coated and hence opaque. When subsequently used as a transparency in a slide projector, for example, the receiver element 10 remains flat and holds its image in focus even though exposed to prolonged thermal or other stresses. One receiver element which is suitable for use in the present invention is disclosed in U.S. application Ser. No. 722,810, entitled "Thermal Dye Transfer Receiver Slide Element" filed on 6/28/91 in the names of Sarraf, DeBoer and Jadrich.

Figure 2:
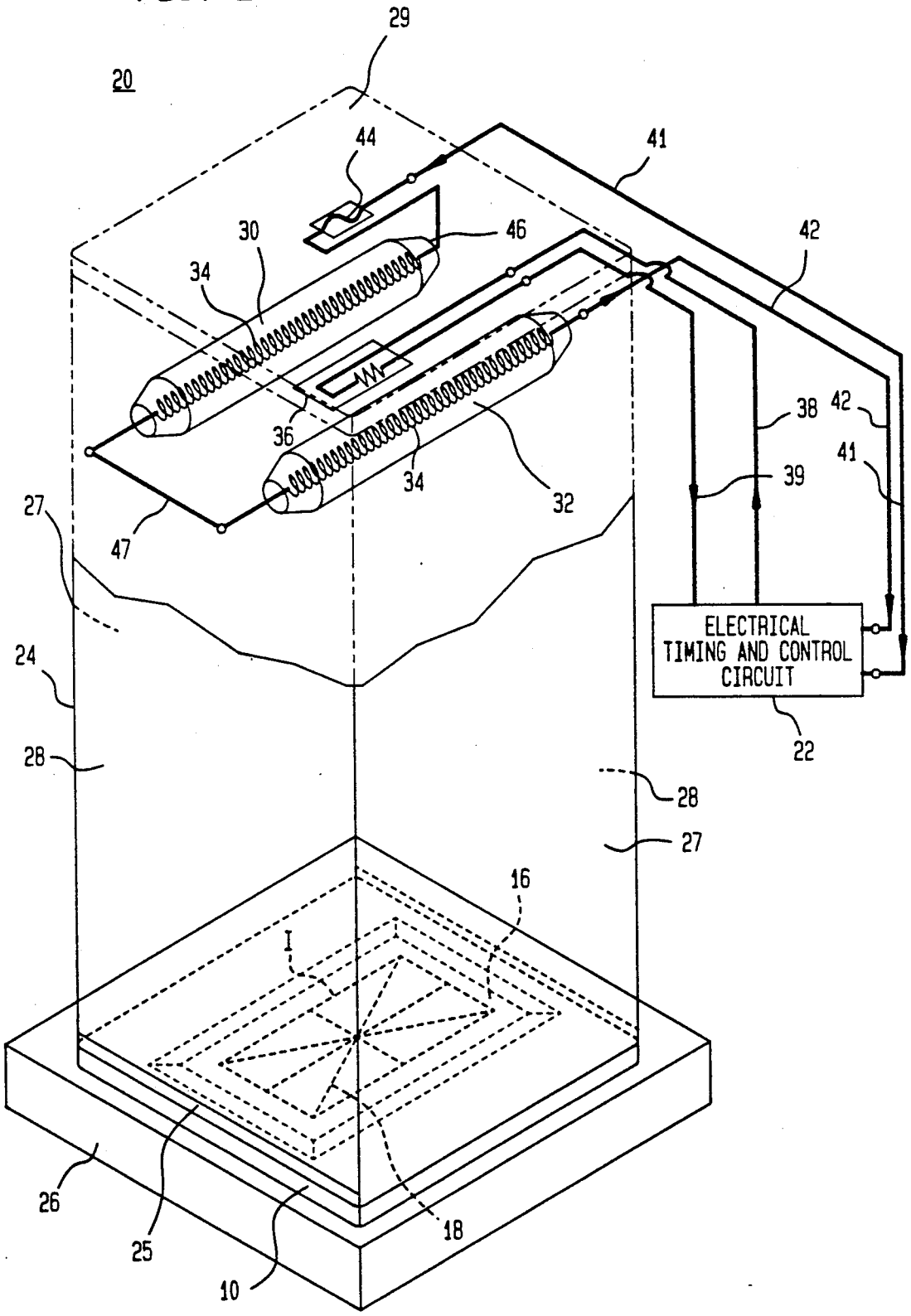
FIG. 2 shows in schematic form apparatus in accordance with one aspect of the invention for thermally fusing an image printed on a receiver element such as shown in FIG. 1.

Referring now to FIG. 2, there is shown a preferred embodiment of a heat fusing apparatus 20 which is shown with a partly broken away section and is in accordance with the present invention. Heat fusing apparatus 20 comprises an electrical timing and control circuit 22 which is described in detail hereinafter (see FIG. 4 and description thereof). The fusing apparatus 20 also comprises a generally rectangular light-integrating chamber 24 which defines a lower end 25 which is open and which is shown covering the receiving element 10 (of FIG. 1) onto which an image (shown as four lines which cross at a common central point) is to be diffused therein. The receiving element 10 is held in position during fusing by a positioning mechanism 26.

Still referring to FIG. 2, the light-integrating chamber 24 has a hollow interior defined by thin vertical front and rear walls 27, and side walls 28 of a highly reflecting material, such as King Lux (trademark) sheet aluminum. The chamber 24 has a flat reflecting top wall 29 made of the same material. Positioned somewhat below the top wall 29 and within the chamber 24, are a pair of tubular quartz lamps 30 and 32, which together provide a source of black-body radiation distributed over an area. Each lamp 30 and 32 has an axial tungsten wire filament 34 which extends along the length of the lamp for approximately the width of top wall 29. The filaments 34, and their lamps 30 and 32, are generally parallel to each other, to the front and rear vertical walls 27 of the chamber 24, and to its top wall 29. The filaments 34 are positioned within light-integrating chamber 24 so that the intensity of light directed onto a receiver element 10 positioned in its lower open end 25 has a desired distribution. By so controlling the distribution of light directed onto the top surface 16 of the receiver element 10, the greater thermal mass of this surface 16 adjacent the thicker edge portions 14 (see FIG. 1) is compensated for. This insures a uniform, even rise in temperature at any point on the surface 16 so that the center as well as the edges and corners of an image I printed on it are uniformly fused. A light mask (not shown) may, if desired, be placed in the open end 25 of chamber 24 to restrict the area over which heat energy is applied to surface 16 of the receiver element 10.

The top wall 29 of light-integrating chamber 24 has affixed to its outer or top surface a temperature measuring thermistor 36 which is connected via a pair of leads 38, 39 to the electrical circuit 22. This thermistor 36 has a short thermal time constant and so it closely follows the temperature rise of the top wall 29 when the lamps 30 and 32 are turned on. Being located outside of light-integrating chamber 24, the thermistor 36 does not interfere with the distribution of light energy onto a receiver element 10. However, the heat fusing apparatus 20 is so designed that the temperature rise measured by the thermistor 36 corresponds accurately to the temperature rise produced at the surface 16 of a receiver element 10 located at the lower open end 25 of light-integrating chamber 24. By continually measuring a signal from the thermistor 36, the electric circuit 22 is able to determine the surface temperature of the receiver element 10 at each instant. When this surface temperature reaches a value at which image fusing is just completed, the electric circuit 22 immediately turns off the lamps 30 and 32. In this way the image on the receiver element 10 is uniformly and permanently fused to it, but the receiver element 10 is left visually free of optical distortion which would otherwise be caused by uneven or excessive melting of its surface 16.

Still referring to FIG. 2, power is supplied by electric circuit 22 to lamps 30 and 32 by a twisted pair of leads 41, 42. The lead 41 is connected to a thermal fuse 44 mounted on top of chamber wall 29. The other end of fuse 44 is connected in series by a short lead 46 to lamp 30 which in turn is connected by a lead 47 to lamp 32 and thence to the other power lead 42.

Now, as mentioned above, in accordance with one aspect of the invention the color temperature of lamps 30 and 32 is controlled to a pre-determined value which insures optimum fusing of an image I onto a receiver element 10. It has been found, by way of example, for a receiver element 10 molded of clear polycarbonate with a melting point of about 150° C., that a color temperature of 1963° Kelvin gave the best fusing of all of the different dye densities of an image into the surface 16 of the receiver element 10. Temperatures below 1800° K. and above 2100° K. gave slightly non-uniform fusing; a temperature range of ±100° K. about the value of 1963° K. gave uniform fusing with these materials. The color temperature of lamps 30 and 32 is adjustably and accurately controlled by electric circuit 22, as will be explained shortly. It is easy therefore to optimize this color temperature for a different thermoplastic material, and for the particular thermal dyes of an image I on receiver element 10.

By using two lamps 30 and 32, the temperature rise at the surface 16 of a receiver element 10 is not only made more nearly perfectly uniform, as explained above, but the available radiant energy is effectively doubled. This means that the time required for fusing is substantially reduced. Moreover, by using a relatively high energy density of controlled color temperature, the surface 16 of a receiver element 10 has time to melt only to a minute depth before lamps 30 and 32, which are electronically controlled, are turned off. Thus an image I on a receiver element 10 is quickly and uniformly fused to it without causing any visual distortion even at projection magnification.

Figure 3:
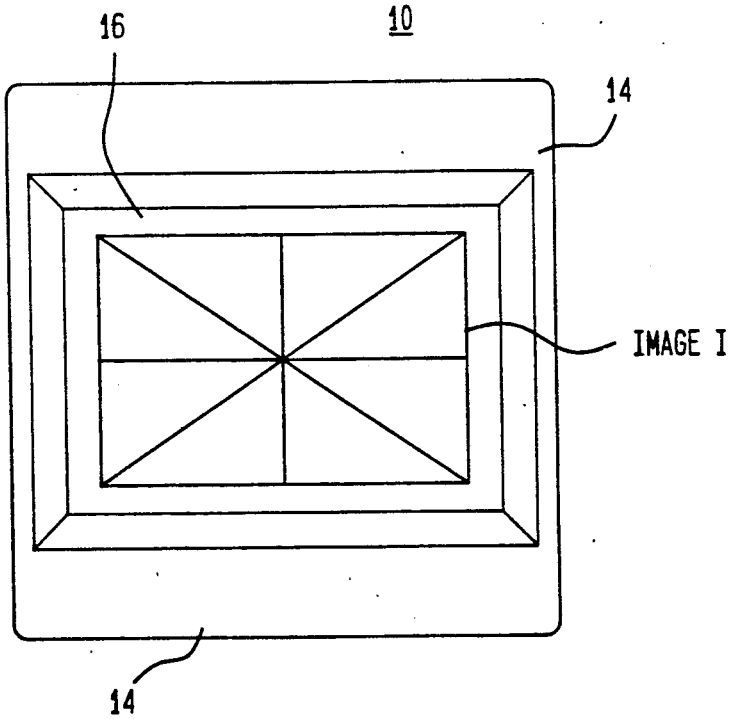
FIG. 3 is a top view of a receiver element such as shown in FIG. 1 after an image has been fused to its surface by the apparatus and method of the present invention.

Referring now to FIG. 3, the receiver element 10 (e.g., slide transparency) has been removed from the fusing apparatus 20 and is shown now with an image I permanently fused onto its top surface 16. The image lies over a generally rectangular area (e.g., 23 mm×34 mm) evenly centered on surface 16 and is uniformly fused throughout the area and along its edges and corners. There is no visual distortion of the image or physical warping of the receiver element 10 after undergoing the fusing operation of the apparatus 20. The fusing operation, which is entirely "dry", takes only about 60 seconds, and by virtue of the invention, is precisely repeatable time after time.

Figure 4:
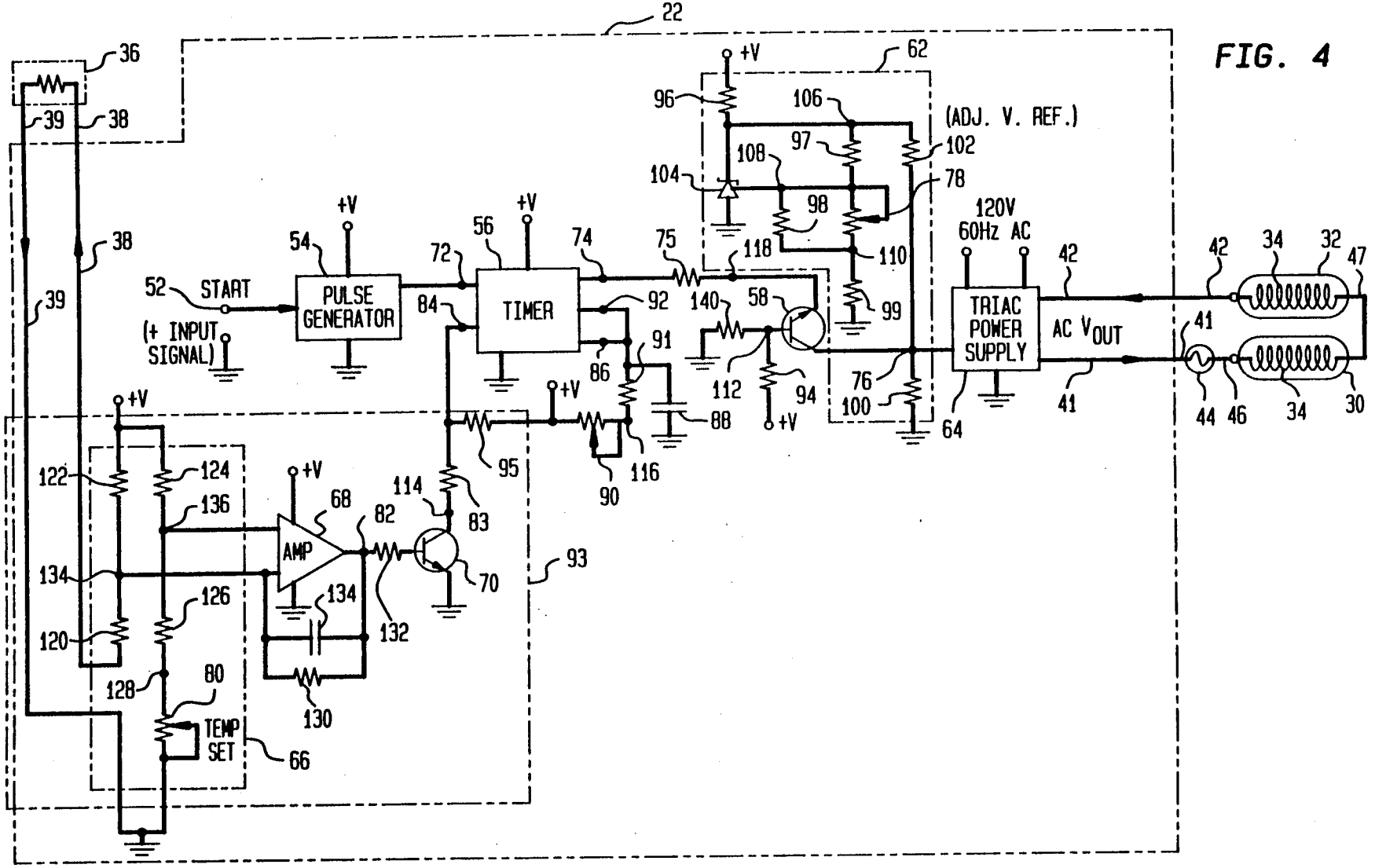
FIG. 4 shows in schematic block form an electrical timing and control circuit provided as part of the thermal fusing apparatus of FIG. 2.

Referring now to FIG. 4, there is shown in schematic and block diagram a preferred embodiment of the electric timing and control circuit 22 (shown within a large dashed line rectangle with a portion removed in the upper left hand corner) of FIG. 2. Circuit 22 comprises a "start" terminal 52, a pulse generator 54, a timer 56, a first control n-p-n transistor 58, an adjustable voltage reference network 62 (shown within a dashed line box), a temperature control circuit 93 (shown within a dashed line rectangle), a rheostat 90, resistors 75, 91, 94, and 140, a capacitor 88, and a triac power supply 64. Circuit 93 comprises a resistance bridge network 66 (shown within a dashed line rectangle), a differential amplifier 68, an n-p-n transistor 70, resistors 83, 95, 130, and 132, and a capacitor 134. Network 66 comprises resistors 120, 122, 124, and 126 and a rheostat 80. The adjustable voltage reference network 62 comprises resistors 96, 97, 98, 99, 100 and 102, a rheostat 78 and an integrated circuit 104 which acts essentially as a zenor diode having a control terminal that is useful to change the breakdown voltage of the zenor diode. In a typical embodiment circuit 104 is a LM385BZ integrated circuit manufactured by National Semiconductor.

The power supply 64 is connected externally via leads 41 and 42 to the quartz lamps 30 and 32, as explained above. As seen at the upper left in FIG. 4, the circuit 22 is connected externally via the leads 38 and 39 to the temperature measuring thermistor 36. The leads 38 and 39 couple the thermistor 36 into the resistance bridge network 66 with lead 39 coupled to ground potential and lead 38 coupled to a first terminal of the resistor 120. In network 66, first terminals of resistors 122 and 124 are coupled to a power supply +V. Second terminals of resistors 120 and 122 are coupled to a first input of amplifier 68 and to a terminal 134. A second terminal of resistor 124 is coupled to a first terminal of resistor 126, to a second input of amplifier 68, and to a terminal 136. Second terminals of resistor 126 and rheostat 80 are coupled to a terminal 128. A combination of the resistor 130 and the capacitor 134 are coupled between the first input (terminal 134) and an output (terminal 82) of the amplifier 68 and serve as feedback elements. The output of amplifier 68 is coupled to the base of transistor 70 through a current limiting resistor 132. The amplifier 68 is coupled between +V and ground potential and the emitter of transistor 70 is coupled to ground potential. The collector of transistor 70 is coupled to a first terminal of the resistor 83 and to a terminal 114. A second terminal of resistor 83 is coupled to a first terminal of the resistor 95 and to a lower input of timer 56. A second terminal of resistor 95 and a first terminal of rheostat 90 are coupled to +V.

In network 62, a first terminal of resistor 96 is coupled to +V. A second terminal of resistor 96 is coupled to an anode of circuit 104, to first terminals of resistors 97 and 102, and to a terminal 106. A control terminal of circuit 104 is coupled to first terminals of resistor 98 and rheostat 78, to a second terminal of resistor 97, and to a terminal 108. An anode of circuit 104 and first terminals of resistors 99 and 100 are coupled to ground potential. Second terminals of resistors 100 and 102 are coupled to a voltage control input of triac power supply 64, to the collector of transistor 58, and to a terminal 76.

The start terminal 52 is coupled to an input of the pulse generator 54 which is coupled between +V and ground potential. An output of the pulse generator 54 is coupled to an upper input of the timer 56 and to a terminal 72. The timer 56 is coupled between +V and ground potential. A first output of the timer 56 is coupled to a first terminal of resistor 75 and to a terminal 74. A second output terminal 86 and a second (intermediate) input terminal 92 of timer 56 are coupled to first terminals of resistor 91 and capacitor 88. Second terminals of resistor 91 and rheostat 90 are coupled to a terminal 116. First terminals of resistors 94 and 140 are coupled to the base of transistor 58 and to a terminal 112. A second terminal of resistor 75 is coupled to the emitter of transistor 58 and to a terminal 118.

The operation of the electric circuit 22 is as follows: A positive going signal (not shown) is applied to the "start" terminal 52, indicating that a receiver element 10 is now in position at the lower end 25 of integrating light chamber 24 of FIG. 2. The start signal, no matter how long it may last, causes pulse generator 54 to produce a single short negative-going pulse which is applied to the upper input (terminal 72) of the timer 56. This starts the timer which now produces on the upper output (terminal 74) thereof a signal which remains positive as long as the timer 56 is running. While timer output (terminal 74) is held positive, the first control transistor 58, which is connected by the emitter thereof to the terminal 74 via the low ohmage resistor 75, is turned off. This in turn permits the input (terminal 76) of power supply 64 to rise to a DC voltage level determined by the adjustable voltage reference network 62, the exact voltage being set by a rheostat 78 within network 62. The DC reference voltage at input terminal 76 in turn controls the AC voltage output applied by power supply 64 to the series connected fuser lamps 30 and 32. In this way the color temperature of the light from these lamps 32, 34 is precisely set and maintained at an optimum value (e.g., 1963° K).

When power is applied to the lamps 30 and 32, they immediately heat up and reach the desired color temperature in only a few seconds. Lamps 32 and 34 also cool off very quickly when power thereto is removed. This means that the lamps 32, 34 do not have to be left on in stand-by condition between fusing operations. Accordingly, power is conserved and no excessive build up of heat in the heat fusing apparatus 20 occurs. When the lamps 30 and 32 are turned on, the top chamber wall 29 (see FIG. 2) and the temperature measuring thermistor 36 (SEE FIGS. 2 and 4) see a rise in temperature. As the temperature rises, the resistance of thermistor 36 drops. Resistors 122 and 124 have equal resistance values and resistors 120 and 126 also have equal values but not necessarily equal to the resistance of resistors 122 and 124. When the resistance of thermistor 36 drops below the value of resistance to which rheostat 80 has been set, the operational amplifier 68, which compares the voltages at its two inputs, drives its output terminal 82 positive. Thus by setting rheostat 80 to a given value corresponding to a desired fusing temperature, and continuously comparing the resistance of temperature sensing thermistor 36 to this value, the instant at which the surface 16 (see FIG. 2) of receiver element 10 (see FIG. 2) reaches fusing temperature is accurately determined. At this instant amplifier 68 applies a positive going electrical signal to terminal 82.

When terminal 82 goes positive, the second control transistor 70 is turned on. The collector of the transistor 70 is coupled via a low ohmage resistor 83 to a lower input terminal 84 of the timer 56. The emitter of transistor 70 is coupled to ground potential. When control transistor 70 turns on, it pulls low (towards ground potential) the voltage of the lower timer input terminal 84 and thereby turns off the timer 56. When the timer is off, its upper output terminal 74 goes low and turns the first control transistor 58 on and thereby pulls the input terminal 76 of power supply 64 to a low value. This turns off the power supply 64 and fuser lamps 30 and 32. At this point an image has just been fused on a receiver element 10. Thereafter, the element 10 is removed from the end of light chamber 24, and another element 10 with an unfused image is put into position for the next fusing cycle and so on.

In the event that temperature measuring thermistor 36 and its associated circuitry fail to turn timer 56 off (when fusing is completed), there is provided a safety or "time-out" circuit which is as follows. The timer 56 has a lower output terminal 86 which when the timer is off is shorted to ground. This holds a capacitor 88 at ground potential. When the timer is turned on (by a "start" signal), lower output terminal 86 is disconnected from ground and allowed to float. This permits the capacitor 88 to begin to charge through the resistor 91 and the rheostat 90 to the +V supply voltage. The rate at which capacitor 88 charges is determined by the setting of the rheostat 90 and the ohmage of resistor 91. Capacitor 88 is also connected to the intermediate input terminal 92 of timer 56. When the voltage on capacitor 88 reaches a positive threshold value, this threshold voltage on input terminal 92 turns the timer 56 off. This turns off the power supply 64 and lamps 30 and 32. The timer 56, when turned off, thereupon by the action of its lower output terminal 86, discharges to ground any voltage across capacitor 88. This "time-out" circuit by the adjustment of its rheostat 90 is, by way of example, set to turn timer 56 off in 70 seconds after "start", a time somewhat longer than the time normally taken by the temperature measuring thermistor 36 to turn the timer off (e.g., about 60 seconds). The thermal overload fuse 44, which is located adjacent the thermistor 36 on the top of light chamber 24, turns the lamps 30 and 32 off if both the thermistor 36 and the time-out circuit fail and the temperature of the chamber 24 exceeds a safe value.

In a fusing apparatus 20, like that shown and described herein, which has been built and successfully operated, the light-integrating chamber 24 has a hollow interior 2 inches by 2 inches by 5.5 inches high. Lamps 30 and 32 were type EHR tungsten filament bulbs each rated at 400 watts 120 volts. They were energized in series with 87.6 volts AC from power supply 64 which was a Vivatron Model 515. This voltage resulted in 80 watts of power to each lamp (160 watts total) and gave a color temperature of 1963° K. The estimated life of bulbs 30 and 32 when operated at this reduced voltage level is very long (some millions of hours). The lamps 30 and 32 were adjustably mounted about an inch below the top wall 29 of light chamber 24 to give a desired light energy distribution at the open end 25 of the chamber 24. Timer 56 was a model ICM 7555 unit. The thermal overload fuse 44, atop chamber 24, was set to open when the temperature seen by the fuse reached about 136° C., a temperature somewhat higher than that at which the thermistor 36, also atop chamber 24, normally turns off the lamps 30 and 32.

It is to be understood that the embodiments of apparatus and method described herein are illustrative of the general principles of the invention. Modifications may readily be devised by those skilled in the art without departing from the spirit and scope of the invention. For example, different sizes, configurations and materials for a receiver element 10 may be used. Also the color temperature type and number of lamps used and energy distribution of the light source may be changed to optimize fusing with different materials.

What is claimed is:

1. An apparatus for fusing an image onto a receiver element, said apparatus comprising:

a light chamber one end of which is adapted to hold a receiver element having an image to be fused onto its surface;

a light source mounted in said chamber to direct radiant energy in a desired pattern onto the receiver element, said light source having a color temperature;

first electric circuit means for turning on and controlling the color temperature of said light source; and second electric circuit means for turning off said light source as soon as the surface of the receiver element reaches a temperature at which the fusing of the image onto the receiver element is completed.

2. The apparatus of claim 1 wherein:

the light source comprises a plurality of lamps arranged within said chamber to provide an area source of black body radiation;

the first electric circuit means comprises a variable voltage power supply connected to the lamps, the output voltage of the power supply being controlled to a desired value by a precisely setable reference voltage thereby controlling the color temperature of the lamps; and the second electric circuit means comprises temperature measuring means for determining the temperature rise at a surface of said light chamber and for immediately turning off said power supply when the temperature has risen to a point at which the fusing of an image onto a receiver element has just been completed.

3. The apparatus in claim 2 further comprising third electric circuit means for turning off said power supply after a given length of time and independently of the operation of said second circuit means.

4. The apparatus in claim 3 further comprising thermal overload means for turning off the lamps in the event the temperature of said light chamber exceeds a pre-set value.

5. An apparatus for quickly and efficiently fusing an image onto a receiver element uniformly over an area and without visual distortion of the receiver element even at high magnification, said apparatus comprising:

a light integrating chamber having an open lower end and a closed top;

positioning means for holding in the open end a receiver element with a top surface having an image to be fused;

a plurality of lamps having filaments which are mounted within said chamber near its top to give a desired energy distribution of light directed onto the top surface of a receiving element; and electric circuit means for turning on said lamps for a short time and for turning off said lamps as soon as the top surface of the receiver element reaches a temperature at which the fusing of the image onto the surface of the element is completed.

6. The apparatus in claim 5 wherein the lamps provide a total power of about 160 watts, said receiver element has an image area of about 23 mm by 34 mm, and the color temperature of said lamps is regulated to a value which gives optimum fusing of the image to the receiver element.

7. A highly efficient system for quickly and uniformly thermally fusing an image onto a meltable surface of a receiver element such as a slide transparency, said system comprising:

positioning means for holding a receiver element with an image to be fused;

a light-integrating chamber above said positioning means for directing high intensity light energy down onto a receiver element and its image, said chamber having internal surfaces and a top which are highly reflecting;

a plurality of lamps having elongated filaments mounted within said chamber near said top to direct radiant energy in a desired pattern of intensity onto the receiver element to produce a uniform temperature rise over the area of the image and along its edges;

first electric circuit means for turning on and controlling the color temperature of said lamps; and second electric circuit means for measuring the temperature rise on a surface in said chamber and for immediately turning off said lamps the instant said surface temperature indicates that fusing of an image onto the receiver element is accomplished.

8. The system in claim 7 wherein said second electric circuit means includes a temperature variable resistor mounted on the top of said light-integrating chamber.

9. The system on claim 7 wherein said first electric circuit means applies to said lamps a supply voltage substantially reduced below their nominal operating voltage, the color temperature of said lamps being set by said supply voltage to optimize fusing of the image to the meltable surface of the receiver element.

10. The system in claim 9 wherein the color temperature of said lamps is set to about 1963° K.

11. A method of uniformly fusing an image onto a thermoplastic surface of a receiver element comprising the steps of:

directing a large amount of radiant light energy onto an unfused image on a thermoplastic surface of a receiver element from a light source which emits black body radiation and which has a color temperature;

controlling the color temperature of the light energy in accordance with optimum absorption of the energy by the image and by the thermoplastic surface of the receiver element;

applying the energy of the radiant light to the thermoplastic surface of the receiver element with uniform temperature rise over the image area including its edges; and measuring the rise in temperature produced by the radiation and turning off the light energy as soon as a desired fusing temperature at the surface of the receiver element is reached such that essentially uniform fusing of the image without essentially any distortion of the receiver element is obtained.

12. A method of thermally fusing a dye-transfer image onto a surface of a thermoplastic receiver element such as a slide transparency, said method comprising the steps of:

directing from a light source which emits black body radiation and has a color temperature, a large amount of radiant light energy onto the unfused dye-transfer image and the surface of the thermoplastic receiver element;

controlling the temperature of the light energy in accordance with optimum absorption of the energy by the dye-transfer image and by the thermoplastic receiver element to give uniform fusing from points of minimum to points of maximum density of the image;

applying the radiant light energy to the image and the receiver element in a controlled pattern to compensate for uneven energy absorption by the receiver element and to obtain highly uniform temperature rise over the area of the image including its edges; and measuring the rise in temperature produced by the light energy and turning off the light source as soon as a desired fusing is reached, so that uniform fusing of the image without distortion of the receiver element is obtained.

13. The method in claim 12 wherein the receiver element is molded of polycarbonate having a melting temperature of about 150° C., and the color temperature is controlled to about 1963° K.

* * * * *